US007715751B2

(12) United States Patent
Sur et al.

(10) Patent No.: US 7,715,751 B2
(45) Date of Patent: May 11, 2010

(54) CLEANING APPARATUS, AND TRANSFER UNIT AND IMAGE FORMING APPARATUS INCLUDING THE SAME

(75) Inventors: Jean-man Sur, Suwon-si (KR); Ho-dong Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 282 days.

(21) Appl. No.: 11/777,502

(22) Filed: Jul. 13, 2007

(65) Prior Publication Data

US 2008/0166151 A1 Jul. 10, 2008

(30) Foreign Application Priority Data

Jan. 4, 2007 (KR) ..... 10-2007-0001112
Mar. 8, 2007 (KR) ..... 10-2007-0022922

(51) Int. Cl.
*G03G 15/16* (2006.01)
*G03G 21/00* (2006.01)

(52) U.S. Cl. ..... 399/101; 399/345

(58) Field of Classification Search ..... 399/101, 399/297, 345, 350, 351
See application file for complete search history.

(56) References Cited

U.S. PATENT DOCUMENTS 4,174,172 A * 11/1979 Lane ..... 399/345 X
4,702,591 A * 10/1987 Tsuda et al. ..... 399/345
5,258,816 A * 11/1993 Haneda et al. ..... 399/345 X
5,390,010 A * 2/1995 Yamahata et al. ..... 399/345 X
5,587,769 A * 12/1996 Sawada et al. ..... 399/101 X
6,785,500 B2 * 8/2004 Takahashi et al. ..... 399/297

* cited by examiner

*Primary Examiner*—Sandra L Brase
(74) *Attorney, Agent, or Firm*—Stanzione & Kim, LLP

(57) ABSTRACT

A transfer unit of an image forming apparatus includes a belt to receive an image developed on a photosensitive medium while rotating in a regular cycle and in contact with an outer circumference of at least one photosensitive medium. A blade arm, which is installed adjacent to the belt, moves to a first position to position a cleaning blade, which is supported by the blade arm, to be in contact with the belt. The cleaning blade is coupled to a pressure unit to bias the cleaning blade towards the belt.

15 Claims, 5 Drawing Sheets

CLEANING APPARATUS, AND TRANSFER UNIT AND IMAGE FORMING APPARATUS INCLUDING THE SAME

CROSS-REFERENCE TO RELATED APPLICATIONS

This application claims priority under 35 U.S.C. § 119(a) from Korean Patent Application No. 2007-1112 filed Jan. 4, 2007, and Korean Patent Application No. 2007-22922, filed Mar. 8, 2007, in the Korean Intellectual Property Office, the entire disclosures of which are hereby incorporated in their entirety by reference.

BACKGROUND OF THE INVENTION

1. Field of the Invention

The present general inventive concept relates to an image forming apparatus. More particularly, the present general inventive concept relates to a cleaning apparatus having an improved structure to remove toner remaining on a transfer medium, and a transfer unit and an image forming apparatus including the same.

2. Description of the Related Art

Generally, an image forming apparatus in which an electrophotographic process is used, for example, a laser beam printer or a copier, develops an electrostatic latent image formed on a photosensitive medium using toner, and transfers the developed image onto a printing medium through a transfer unit to output a desired image.

The transfer unit includes a belt which is installed between at least two rollers and rotates following a regular cycle. The belt is provided so as to be in contact with the outer circumference of at least one photosensitive medium, and the image developed on the photosensitive medium is thus transferred to the belt.

The belt cleaning apparatus removes unnecessary toner remaining on the belt after an image primarily transferred to the belt is secondarily transferred onto paper, and accordingly keeps the belt in a clear state.

FIG. 1 is a view schematically showing a general belt cleaning apparatus. As illustrated in FIG. 1, a belt 1 is wound around a roller 2 and rotates following a regular cycle. Additionally, a leading end of a cleaning blade 3, which is mounted on a blade bracket 4, is in contact with the belt 1 wound around the roller 2. Accordingly, the toner remaining on the belt 1 is removed by the cleaning blade 3.

The blade bracket 4 is constituted to move to a first position and a second position by a cam (not illustrated) so that the cleaning blade 3 can be selectively in contact with the belt 1. The first position is a position in which the cleaning blade 3 is in contact with the belt 1, as illustrated in FIG. 1, and the second position (not illustrated) is a position in which the cleaning blade 3 is separated from the belt 1.

When toner image formed on the photosensitive medium is transferred to the belt 1, or toner image of the belt 1 is transferred onto the printing medium, the cleaning blade 3 may be separated from the belt 1 via the blade bracket 4 being placed in the second position. Additionally, when the transferring process is completed, the blade bracket 4 may be moved to the first position by the cam, and thus the cleaning blade 3 is placed in contact with the belt 1 to remove non-transferred toner thereon.

However, in the typical belt cleaning apparatus as described above, since the cam enables the cleaning blade 3 be in contact with or separated from the belt 1 by applying a relatively large force, the leading end of the cleaning blade 3 may be damaged or the cleaning blade 3 may be bent. If the cleaning blade 3 is damaged or bent, it can no longer remove toner remaining on the belt. In this situation, it would be required to replace or repair the cleaning blade.

SUMMARY OF THE INVENTION

The present general inventive concept provides a cleaning apparatus which prevents a cleaning blade from being damaged and turned over by having an improved contact structure between the cleaning blade and a transfer medium.

The present general inventive concept also provides a transfer unit and an image forming apparatus including the cleaning apparatus, in which a cleaning blade is brought in contact with a transfer medium through two stations to prevent damage to the cleaning blade, thereby achieving improved durability of the cleaning blade and enabling miniaturization of the cleaning blade by increasing the freedom of design.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a cleaning apparatus including a blade arm, which is installed adjacent to a transfer medium, to move to a first position and a second position, a cleaning blade, which is supported by the blade arm, to be in contact with the transfer medium when the blade arm moves to the first position, and a pressure unit to bias the cleaning blade towards the transfer medium.

The blade arm may pivot at a first hinge point, and may further include a driving cam to rotate and move the blade arm to the first and second positions.

The cleaning blade may be installed on the blade arm to pivot at a second hinge point.

The pressure unit may include a blade bracket which is installed between the first and second hinge points, and a spring which is interposed between a support bracket at the first hinge point and the blade bracket.

The foregoing and/or other aspects and utilities of the present general inventive concept may be achieved by providing a transfer unit of an image forming apparatus, the transfer unit including a transfer medium to receive an image developed on a photosensitive medium while rotating in a regular cycle and in contact with an outer circumference of at least one photosensitive medium, a transfer roller to transfer the image transferred onto the transfer medium to a printing medium, and a cleaning apparatus, as described above, to remove toner that is not transferred onto the printing medium and that remains on the transfer medium.

The foregoing and/or other aspects and utilities of the present general inventive concept may also be achieved by providing an image forming apparatus including at least one photosensitive medium on which an electrostatic latent image is formed, a developing unit to develop the electrostatic latent image formed on the photosensitive medium, a transfer unit, as described above, to transfer the image developed on the photosensitive medium to a printing medium, a fixing unit to fix the image transferred onto the printing medium, and a discharging unit to discharge the printing medium on which the image is fixed.

The foregoing and/or other aspects and utilities of the present general inventive concept are also achieved by providing an apparatus to clean a continuous belt including a blade arm to oscillate over a predetermined period associated with a rotation rate of the belt, and a cleaning blade elastically coupled to the blade arm and biased against the belt over a predetermined interval in the period.

The foregoing and/or other aspects and utilities of the present general inventive concept are also achieved by providing a transfer unit of an image forming apparatus including a continuous belt to carry toner applied to an electrostatic image to a print medium path of the image forming apparatus, a blade arm to oscillate over a predetermined period associated with a rotation rate of the belt, and a cleaning blade coupled to the blade arm and biased against the belt over a predetermined interval in the period.

The foregoing and/or other aspects and utilities of the present general inventive concept are also achieved by providing an image forming apparatus including a photosensitive medium to receive an electrostatic latent image, a print medium path conveying print media therethrough, a developing unit to apply toner to the photosensitive medium to form a developed image, a continuous belt to receive the developed image thereon and to convey the developed image to the print medium path, a fixing unit to adhere the developed image to a print medium in the print medium path, a blade arm to oscillate over a period corresponding to a rate at which the developed image is received on the belt, and a cleaning blade coupled to the blade arm and biased against the belt over a predetermined interval in the period.

The foregoing and/or other aspects and utilities of the present general inventive concept are also achieved by providing a method to clean a continuous belt including rotating the belt at a predetermined rotation rate, contacting the belt with a cleaning blade at least once per rotation of the belt, and biasing the cleaning blade against the belt for a predetermined interval subsequent to the cleaning blade contacting the belt.

The foregoing and/or other aspects and utilities of the present general inventive concept are also achieved by providing an image forming method including applying toner to a photosensitive medium on which a latent image has been formed to form a developed image, positioning a cleaning blade to be removed from a transfer belt and transferring the developed image to the transfer belt, transferring the developed image to a printable medium, positioning the cleaning blade proximal to the transfer belt, and biasing the cleaning blade against the transfer belt to remove toner therefrom upon the developed image on the transfer belt being transferred to the printable medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
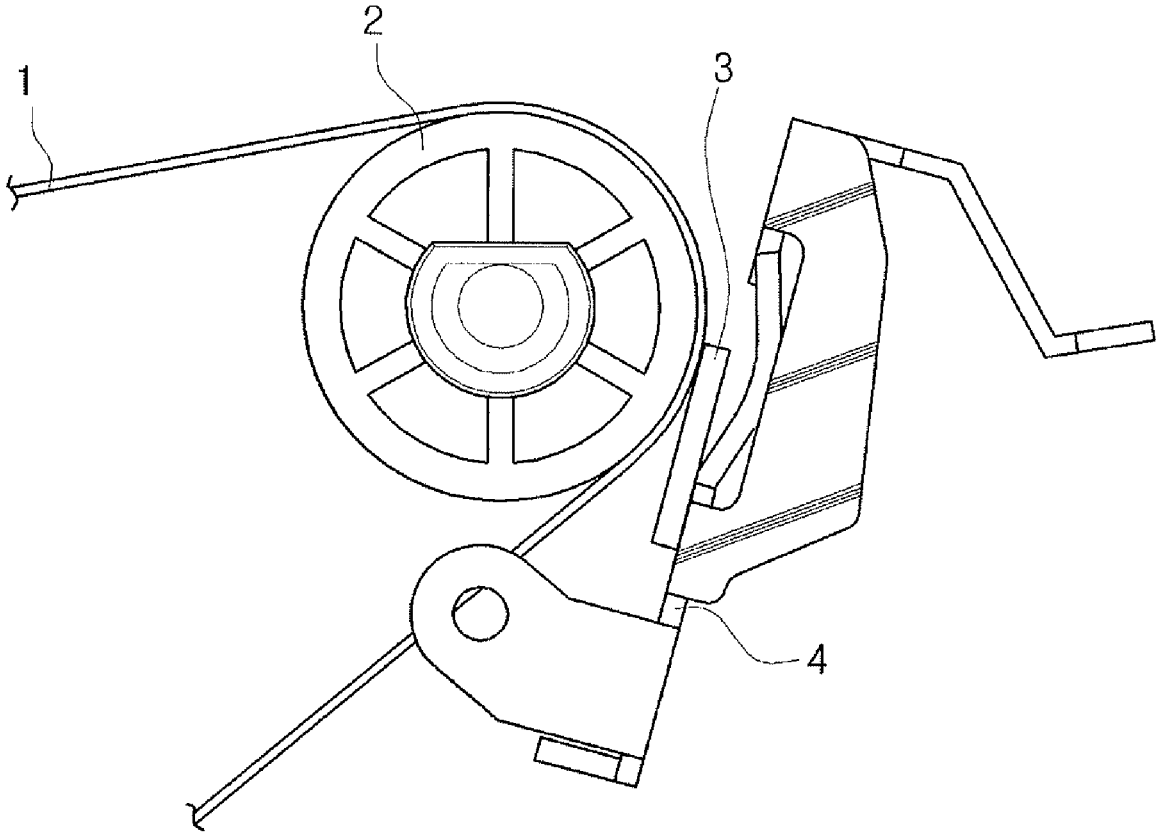
FIG. 1 (RELATED ART)
FIG. 1 is an exemplary view schematically illustrating a general belt cleaning apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
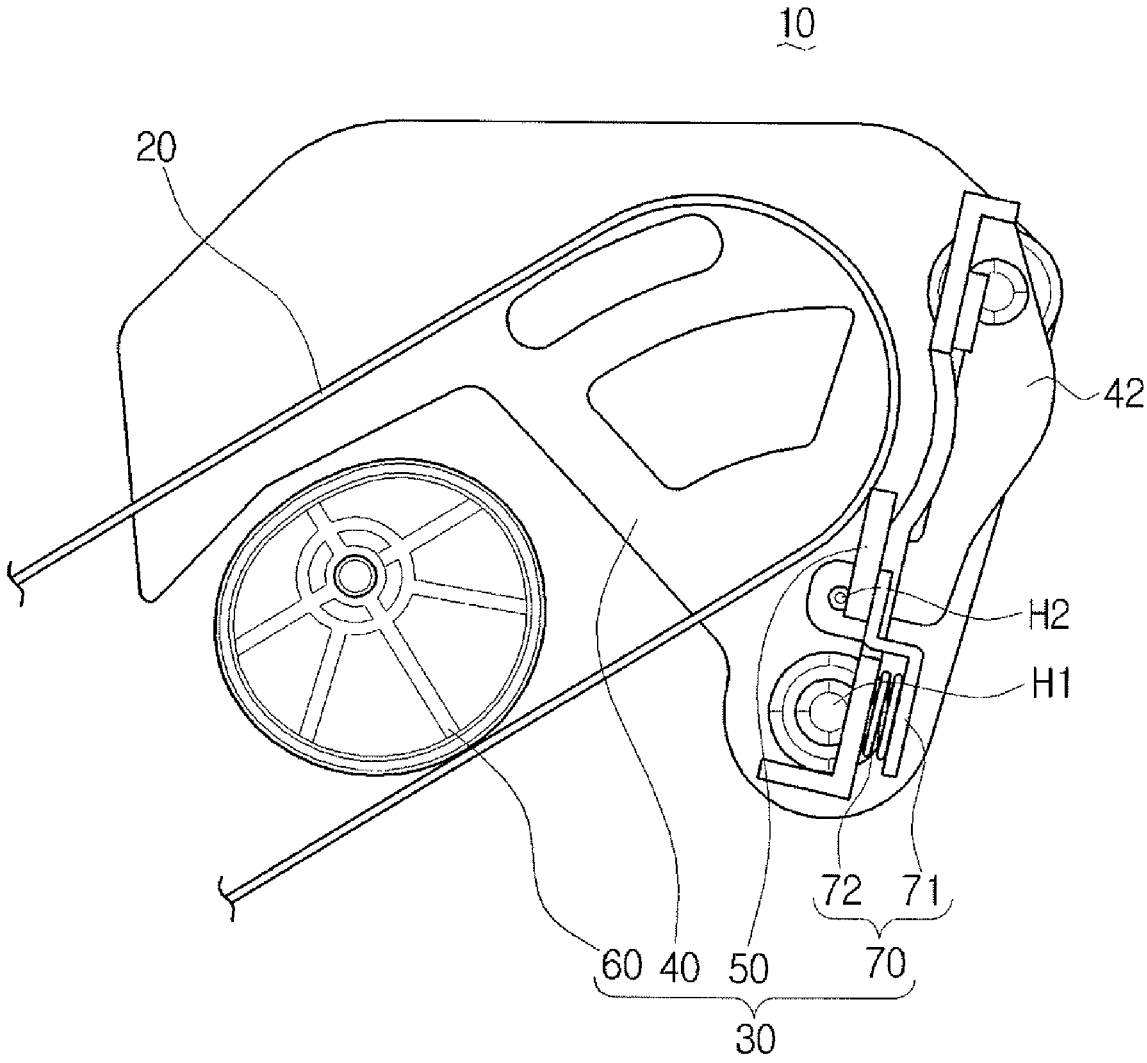
FIGS. 2 and 3 are views respectively illustrating a position in which a cleaning blade is in contact with a belt and a position in which the cleaning blade is separated from the belt, to explain the configuration and operation of a belt cleaning apparatus according to an exemplary embodiment of the present general inventive concept.
Figure 3:
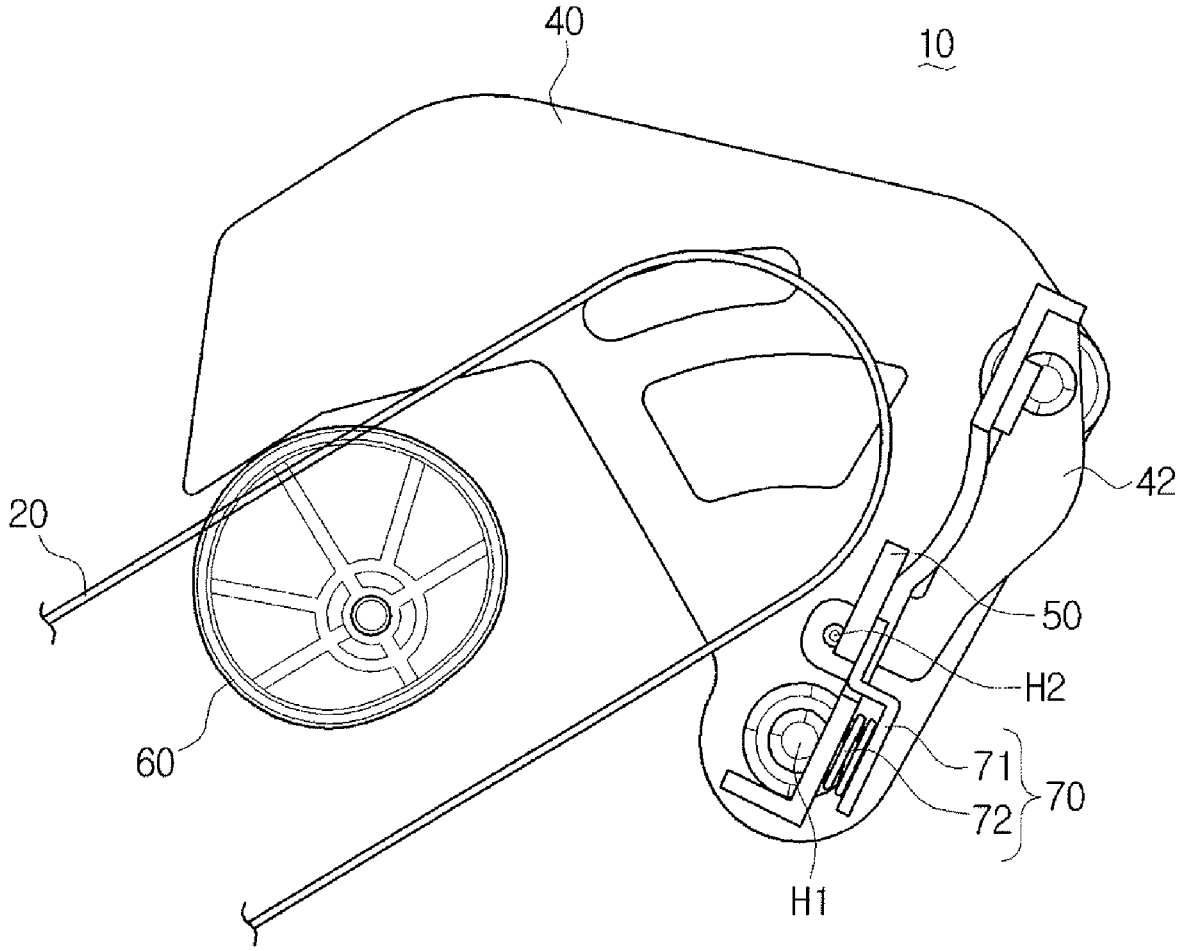

FIGS. 2 and 3 are views illustrating the configuration and operation of a belt cleaning apparatus according to an exemplary embodiment of the present general inventive concept. Specifically, FIG. 2 is a view illustrating a position in which a cleaning blade is in contact with a belt, and FIG. 3 is a view illustrating a position in which the cleaning blade is separated from the belt.

In FIGS. 2 and 3, a transfer unit 10 includes a belt 20 and a belt cleaning apparatus 30.

The belt 20 may be supported by at least two rollers 21 and 22 (referring to FIG. 5) and rotates following to a regular cycle. Additionally, the belt 20 may be in contact with the outer circumference of at least one photosensitive medium 80 (referring to FIG. 5), and thus toner image developed on the photosensitive medium 80 may be transferred to the belt 20.

Figure 5:
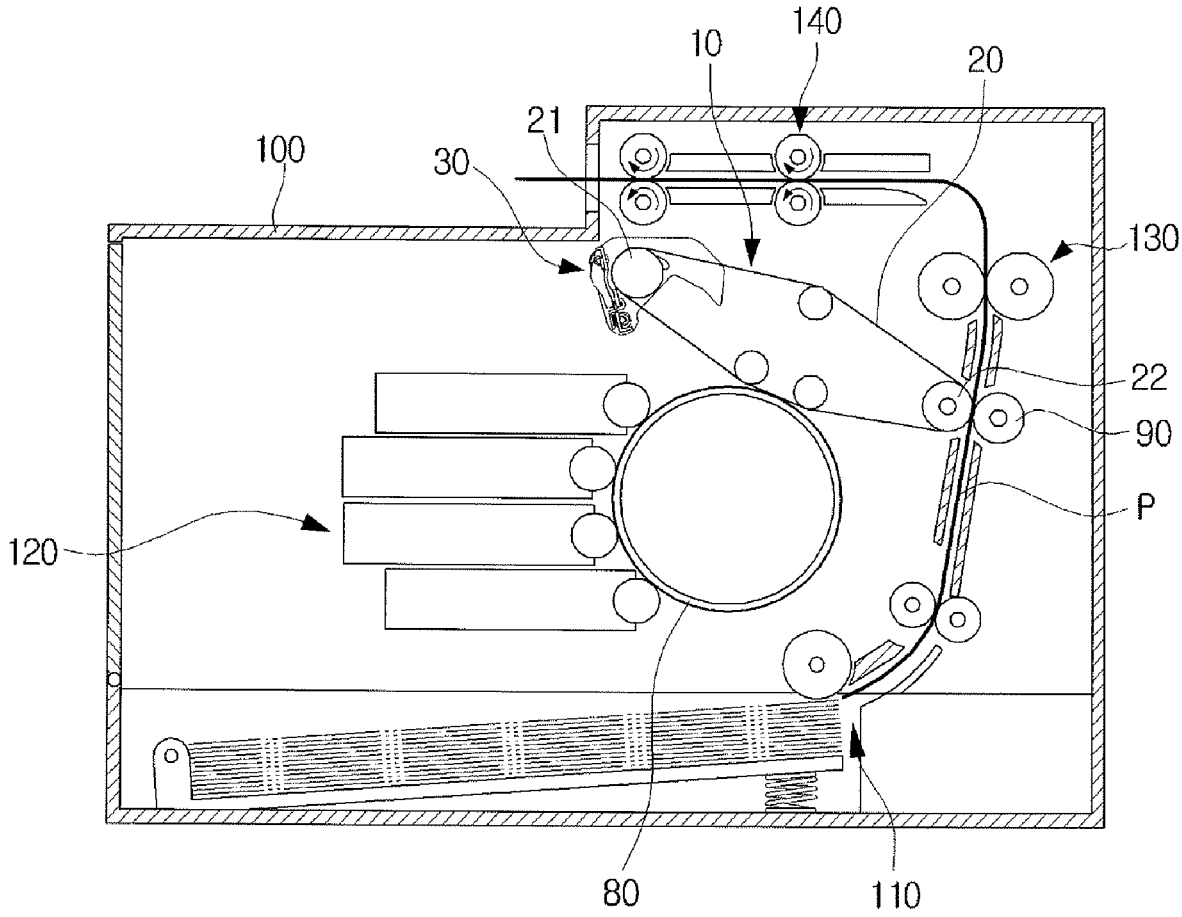
FIG. 5 is an exemplary view schematically illustrating a transfer unit employing the belt cleaning apparatus according to an exemplary embodiment of the present general inventive concept, and an image forming apparatus including the transfer unit.

Referring to FIG. 5, a transfer roller 90 may be installed so as to be in contact with the exterior of the belt 20, and the image primarily transferred to the belt 20 may be secondarily transferred onto a printing medium P which passes between the transfer roller 90 and belt 20.

The belt cleaning apparatus 30 according to an exemplary embodiment of the present general inventive concept removes superfluous toner remaining on the belt 20, that is, toner which is not transferred onto the printing medium P and that remains on the belt 20. The belt cleaning apparatus 30 may include a blade arm 40, a cleaning blade 50, a driving cam 60, and a pressure unit 70.

The blade arm 40 may be mounted adjacent to the belt 20 to pivot at a first hinge point H1. The blade arm 40 may oscillate between at least two positions, that is, a first position and a second position. The first position may be a position in which the cleaning blade 50 is in contact with the belt 20, and the second position may be a position in which the cleaning blade 50 is separated from the belt 20.

The cleaning blade 50 may be connected to the blade arm 40 through a support bracket 42. As the blade arm 40 moves to the first position, a leading end of the cleaning blade 50 comes in contact with the belt 20, which is referred to herein as the "first station" of the cleaning blade 50.

The driving cam 60 may be eccentric to move the blade arm 40 between the first and second positions by actuating the blade arm 40. The driving cam 60 and the interaction thereof with the blade arm 40 imposes an oscillation of the blade arm 40 having a period corresponding to the image forming rate of the image forming apparatus implementing the present general inventive concept.

The cleaning blade 50 may be pivoted on the support bracket 42 about a second hinge point H2 and biased towards the belt 20. The pressure unit 70 relieves a shock caused by the initial contact of the cleaning blade 50 on the belt 20 when the cleaning blade 50 is in the first station, and simultaneously biases the cleaning blade 50 against the belt 20 to control the force the cleaning blade 50 applied to the belt 20 so that toner remaining on the belt 20 can be removed. Upon application of the biasing force on the cleaning blade 50, and consequently on the belt 20, the cleaning blade 50 is positioned in what is referred to herein as the "second station."

The pressure unit 70 includes a blade bracket 71 placed between the first and second hinge points H1 and H2, and a biasing element 72 interposed between the support bracket 42 and the blade bracket 71 to bias the cleaning blade 50. In the exemplary embodiment of the present general inventive concept, a coil spring is illustrated as the biasing element 72, but other biasing elements, such as, for example, a leaf spring may be used to bias the cleaning blade 50 towards the belt 20. The biasing element 72 and the eccentricity of the driving cam 60 together establish a time interval during which the cleaning blade 50 remains in contact with the belt 20. The time interval may vary by application of the present general inventive concept, as will be appreciated by the skilled artisan, and the characteristics of the biasing element, such as the spring constant, the type, the length, etc., and the eccentricity of the driving cam, such as the axle location and the peripheral contour, can be selected for the desired time interval.

Figure 4:
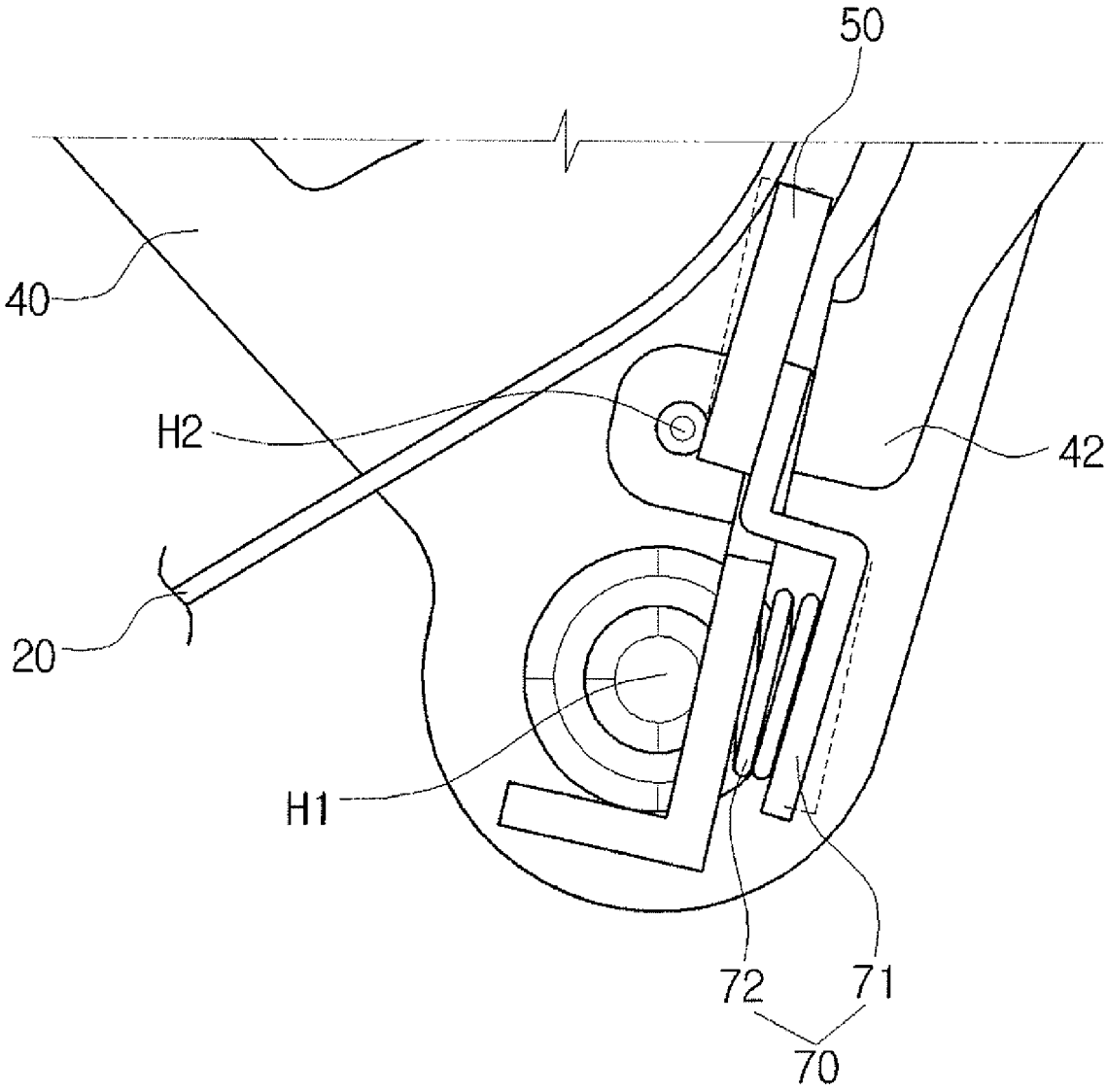
FIG. 4 is an enlarged view illustrating the pressure structure and operation of the cleaning blade of the exemplary embodiment of the present general inventive concept.

FIG. 4 illustrates the operation of the pressure unit 70 as constructed in accordance with the exemplary embodiment described above. In FIG. 4, the blade arm 40 is placed in the first position, the cleaning blade 50, indicated by a solid line, is located at the first station, i.e., the position where the cleaning blade 50 comes into contact with the belt 20 and immediately prior to application of the biasing force by the pressure unit 70. The cleaning blade 50 at the position indicated by a dotted line is located at the second station, i.e., the position where the cleaning blade 50 is biased against the belt 20 by the pressure unit 70. In other words, the cleaning blade 50 is brought into contact with the belt 20 through two stations. Accordingly, the cleaning blade 50 can be brought in contact with, or separated from the belt 20 in a more controlled manner than in a conventional construction in which the cleaning blade 50 is brought in contact with the belt 20 through a single motion of a rigidly mounted cleaning blade. Therefore, damage to the leading edge of the cleaning blade 50 and the problems of the cleaning blade 50 bending can be prevented.

FIG. 5 is an exemplary view schematically illustrating an image forming apparatus including a transfer unit 10 in which the belt cleaning apparatus 30 according to an exemplary embodiment of the present general inventive concept is employed. As illustrated in FIG. 5, a feeding unit 110 is placed on a lower part of a main body 100 of the image forming apparatus, and a developing unit 120 is placed on one side of the photosensitive medium 80. The electrostatic latent image formed on the photosensitive medium 80 is developed into a visible image by the developing unit 120. The toner image developed on the photosensitive medium 80 is primarily transferred to the transfer unit 10. The printing medium P picked up by the feeding unit 110 is transferred between the belt 20 and transfer roller 90 of the transfer unit 10. The toner image primarily transferred to the belt 20 is secondarily transferred onto the printing medium P. The printing medium P onto which the toner image is transferred passes through a fixing unit 130 and a discharging unit 140 to be discharged to the outside.

As the toner image developed on the photosensitive medium is transferred to the belt 20, the blade arm 40 is located in the second position, as illustrated in FIG. 3. Accordingly, the cleaning blade 50 is separated from the belt 20.

Additionally, if all toner images formed on the photosensitive medium are transferred to the belt 20, and then the toner image on the belt 20 is finally transferred onto the printing medium P, which is fed between the belt 20 and transfer roller 90, the driving cam 60 can be operated to pivot the blade arm 40. Accordingly, the blade arm 40 is moved to the first position.

When the blade arm 40 is in the first position, as illustrated in FIG. 2, the leading end of the cleaning blade 50 is in contact with the belt 20, and the toner remaining on the belt 20 is then removed. In the situation, when the cleaning blade 50 is in contact with the belt 20 in the first station by moving the blade arm 40 to the first position, the shock caused by contact in the first station between the cleaning blade 50 and the belt 20 is relieved by the pressure unit 70, and thus damage to the leading edge of the cleaning blade is prevented as is the problem of the cleaning blade bending, which occur in the conventional systems.

Additionally, the pressure unit 70 biases the cleaning blade 50 while relieving the shock caused by the initial contact in the first station of the cleaning blade 50, and accordingly, the cleaning blade 50 being brought fully in contact with the belt 20 in the second station removes the toner remaining on the belt 20 in a controlled manner.

In traditional image forming systems, since the cleaning blade is rigidly mounted on the blade arm and is in contact with or separated from the belt by the rotation of the blade arm through the driving cam, the cleaning blade can be damaged and bent from the significant shock caused by the contact. However, in the exemplary embodiment of the present general inventive concept, the cleaning blade 50 is in contact with the belt 20 at the first station by the blade arm 40 being pivoted by the driving cam 60, and the pressure unit 70 relieves the shock resulting from the contact. Additionally, the pressure unit 70 maintains the contact of the cleaning blade 50 with the belt 20 in the second station, and thus the cleaning blade 50 can be protected from being damaged or bent.

As described above, according to exemplary embodiments of the present general inventive concept, it is possible to reduce the damage and bending of the cleaning blade, and thus the durability of the cleaning blade can be improved. In addition, the cleaning efficiency of the belt can increase to enhance the transfer quality.

Furthermore, contact between the cleaning blade and the belt can be controlled by the driving cam and pressure unit through two stations, and accordingly, the hinge points of the blade arm can be freely designed, thus enabling miniaturization of the cleaning blade.

Although the transfer unit and cleaning apparatus in which the transfer belt is used are described in the present general inventive concept above, the transfer belt is merely an example of the transfer medium, and accordingly a transfer drum may also be used as the transfer medium. Therefore, the cleaning apparatus according to the present general inventive concept can also be usefully applied to the transfer drum.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A cleaning apparatus comprising:

a blade arm, which is installed adjacent to a transfer medium, to move to a first position and a second position;

a cleaning blade, which is supported by the blade arm, to be in contact with the transfer medium when the blade arm moves to the first position;

a pressure unit to bias the cleaning blade towards the transfer medium; and a driving cam to rotate and move the blade arm to the second position, wherein the blade arm moves to the first position by its self-weight.

2. The cleaning apparatus as claimed in claim 1, wherein the blade arm is pivotable on a first hinge point.

3. The cleaning apparatus as claimed in claim 2, wherein the cleaning blade is installed on the blade arm to pivot on a second hinge point.

4. The cleaning apparatus as claimed in claim 3, wherein the pressure unit comprises:

a blade bracket which is installed between the first and second hinge points; and a spring which is interposed between a support bracket at the first hinge point and the blade bracket.

5. A transfer unit of an image forming apparatus, the transfer unit comprising:

a transfer medium to receive an image developed on a photosensitive medium while rotating in a regular cycle and in contact with an outer circumference of the photosensitive medium;

a transfer roller to transfer an image transferred on the transfer medium to a printing medium;

a blade arm, which is installed adjacent to the transfer medium, to move to a first position and a second position;

a cleaning blade, which is supported by the blade arm, to be in contact with the transfer medium when the blade arm moves to the first position;

a pressure unit to bias the cleaning blade towards the transfer medium; and a driving cam to rotate and move the blade arm to the second position, wherein the blade arm moves to the first position by its self-weight.

6. The transfer unit as claimed in clam 5, wherein the blade arm is pivotable on a first hinge point.

7. The transfer unit as claimed in claim 6, wherein the cleaning blade is installed on the blade arm so as to pivot on a second hinge point.

8. The transfer unit as claimed in claim 7, wherein the pressure unit comprises:

a blade bracket which is installed between the first and second hinge points; and a spring which is interposed between a support bracket at the first hinge point and the blade bracket.

9. An image forming apparatus comprising:

at least one photosensitive medium on which an electrostatic latent image is formed;

a developing unit to develop the electrostatic latent image formed on the photosensitive medium;

a transfer unit to transfer the image developed on the photosensitive medium to a printing medium;

a fixing unit to fix the image transferred onto the printing medium; and a discharging unit to discharge the printing medium on which the image is fixed, wherein the transfer unit comprises:

a transfer medium to receive an image developed on the photosensitive medium while rotating in a regular cycle and in contact with an outer circumference of at least one photosensitive medium;

a transfer roller to transfer an image transferred on the transfer medium to the printing medium;

a blade arm, which is installed adjacent to the transfer medium, to move to a first position and a second position;

a cleaning blade, which is supported by the blade arm, to be in contact with the transfer medium when the blade arm moves to the first position;

a pressure unit to pressurize the cleaning blade towards the transfer medium; and a driving cam to rotate and move the blade arm to the second position, wherein the blade arm moves to the first position its self-weight.

10. The image forming apparatus as claimed in claim 9, wherein the blade arm is rotatable about a first hinge point.

11. The image forming apparatus as claimed in claim 10, wherein the cleaning blade is installed on the blade arm so as to rotate about a second hinge point.

12. The image forming apparatus as claimed in claim 11, wherein the pressure unit comprises:

a blade bracket which is installed between the first and second hinge points; and a spring which is interposed between the first hinge point and blade bracket.

13. A cleaning apparatus comprising:

a blade arm, which is installed adjacent to a transfer medium, to move to a first position and a second position;

a cleaning blade, which is supported by the blade arm, to be in contact with the transfer medium when the blade arm moves to the first position; and a pressure unit to bias the cleaning blade towards the transfer medium, wherein the pressure unit comprises:

a blade bracket which is installed between the first and second hinge points; and a spring which is interposed between a support bracket at the first hinge point and the blade bracket.

14. A transfer unit of an image forming apparatus, the transfer unit comprising:

a transfer medium to receive an image developed on a photosensitive medium while rotating in a regular cycle and in contact with an outer circumference of the photosensitive medium;

a transfer roller to transfer an image transferred on the transfer medium to a printing medium;

a blade arm, which is installed adjacent to the transfer medium, to move to a first position and a second position;

a cleaning blade, which is supported by the blade arm, to be in contact with the transfer medium when the blade arm moves to the first position; and a pressure unit to bias the cleaning blade towards the transfer medium, wherein the pressure unit comprises:

a blade bracket which is installed between the first and second hinge points; and a spring which is interposed between a support bracket at the first hinge point and the blade bracket.

15. An image forming apparatus comprising:

at least one photosensitive medium on which an electrostatic latent image is formed;

a developing unit to develop the electrostatic latent image formed on the photosensitive medium;

a transfer unit to transfer the image developed on the photosensitive medium to a printing medium;

a fixing unit to fix the image transferred onto the printing medium; and a discharging unit to discharge the printing medium on which the image is fixed, wherein the transfer unit comprises:

a transfer medium to receive an image developed on the photosensitive medium while rotating in a regular cycle and in contact with an outer circumference of at least one photosensitive medium;

a transfer roller to transfer an image transferred on the transfer medium to the printing medium;

a blade arm, which is installed adjacent to the transfer medium, to move to a first position and a second position;

a cleaning blade, which is supported by the blade arm, to be in contact with the transfer medium when the blade arm moves to the first position; and a pressure unit to pressurize the cleaning blade towards the transfer medium, wherein the pressure unit comprises:

a blade bracket which is installed between the first and second hinge points; and a spring which is interposed between the first hinge point and blade bracket.

* * * * *